US010048027B2

(12) United States Patent
Eisermann et al.

(10) Patent No.: US 10,048,027 B2
(45) Date of Patent: Aug. 14, 2018

(54) METHOD AND DEVICE FOR CLEANING TUBE BUNDLES

(71) Applicant: LOBBE INDUSTRIESERVICE GMBH & CO KG, Iserlohn (DE)

(72) Inventors: Reinhard Eisermann, Iserlohn (DE); Bodo Skaletz, Dinslaken (DE)

(73) Assignee: LOBBE INDUSTRIESERVICE GMBH & CO KG, Iserlohn (DE)

( * ) Notice: Subject to any disclaimer, the term of this patent is extended or adjusted under 35 U.S.C. 154(b) by 0 days.

(21) Appl. No.: 15/124,461

(22) PCT Filed: Mar. 27, 2015

(86) PCT No.: PCT/EP2015/056734
§ 371 (c)(1),
(2) Date: Sep. 8, 2016

(87) PCT Pub. No.: WO2015/144889
PCT Pub. Date: Oct. 1, 2015

(65) Prior Publication Data

US 2017/0016687 A1 Jan. 19, 2017

(30) Foreign Application Priority Data

Mar. 28, 2014 (DE) ..... 10 2014 104 356

(51) Int. Cl.
*F28G 9/00* (2006.01)
*F28G 1/16* (2006.01)
(Continued)

(52) U.S. Cl.
CPC ..... *F28G 1/163* (2013.01); *B08B 9/0321* (2013.01); *B08B 9/0325* (2013.01); *F28D 7/103* (2013.01);
(Continued)

(58) Field of Classification Search
CPC ..... B08B 9/0321; B08B 9/0325; F28G 1/163; F28G 15/003; F28G 15/04; F28G 15/06;
(Continued)

(56) References Cited

U.S. PATENT DOCUMENTS 4,095,305 A 6/1978 Goodwin
4,691,723 A 9/1987 Mierswa et al.
(Continued)

FOREIGN PATENT DOCUMENTS

DE 400 031 C 8/1924
DE 34 18 835 C2 11/1985
(Continued)

*Primary Examiner* — Davis Hwu
(74) *Attorney, Agent, or Firm* — Hudak, Shunk & Farine Co., LPA

(57) ABSTRACT

A method for cleaning tube bundles with open end faces, in particular tube bundles of heat exchangers, air coolers, or condensers. A cleaning device which has at least one cleaning unit is positioned adjacently to the open ends of the tube bundle, and the at least one cleaning unit which has a high-pressure hose is then arranged in a successive manner by a controller so as to be flush with the respective tube of the tube bundle. The cleaning unit is inserted into the respective tube and supplied with a liquid under high-pressure. The aim of the invention is to improve such a method and device such that a reliable cleaning process is carried out without operating errors. This is achieved in that the insert depth is measured when inserting the at least one cleaning unit into the respective tube and monitored by the controller.

32 Claims, 5 Drawing Sheets

(51) Int. Cl.

| | |
|---|---|
| ***B08B 9/032*** | (2006.01) |
| ***F28G 15/00*** | (2006.01) |
| ***F28G 15/08*** | (2006.01) |
| ***F28D 7/10*** | (2006.01) |
| ***F28G 15/04*** | (2006.01) |
| ***F28G 15/06*** | (2006.01) |

(52) U.S. Cl.
CPC ..... *F28G 15/003* (2013.01); *F28G 15/04* (2013.01); *F28G 15/06* (2013.01); *F28G 15/08* (2013.01)

(58) Field of Classification Search
CPC ..... F28G 15/08; F28D 7/103; F22B 37/483; B05B 12/124; B05B 15/04; B05B 12/085; B05B 12/082
USPC ..... 165/303
See application file for complete search history.

(56) References Cited

U.S. PATENT DOCUMENTS

| | | | | |
|---|---|---|---|---|
| 5,564,371 | A * | 10/1996 | Ashton | F22B 37/483 122/379 |
| 6,681,839 | B1 | 1/2004 | Balzer | |
| 8,048,234 | B2 | 11/2011 | Jacquinet | |
| 8,057,602 | B2 | 11/2011 | Koelmel et al. | |
| 2004/0035445 | A1 * | 2/2004 | Saxon | B08B 9/0321 134/8 |

FOREIGN PATENT DOCUMENTS

| | | | |
|---|---|---|---|
| DE | 255202 | A1 | 3/1988 |
| GB | 2 320 076 | A | 6/1998 |

* cited by examiner

METHOD AND DEVICE FOR CLEANING TUBE BUNDLES

FIELD OF THE INVENTION

The invention concerns a method for cleaning of tube bundles with open end faces, especially tube bundles of heat exchangers, air coolers or condensers wherein a cleaning device having at least one cleaning unit is positioned adjacent to the open ends of the tube bundle and then the cleaning unit comprising at least one high-pressure hose is arranged by a control unit successively flush with the particular tube of the tube bundle and the cleaning unit is shoved into the particular tube and supplied with a liquid under high pressure.

Moreover, the invention concerns a device for the cleaning of tube bundles with open end faces, especially tube bundles of heat exchangers, air coolers or condensers, comprising: frame elements which can be traveled in horizontal and vertical direction by a control unit, in which is disposed at least one drive unit for a cleaning unit comprising a high-pressure hose and connected to the control unit, wherein the cleaning unit can be shoved by the drive unit into the tubes of the tube bundle; and a device for cleaning of tube bundles with open end faces, especially tube bundles of heat exchangers, air coolers or condensers, comprising: a displacement unit, which comprises at least a first frame element and at least a second frame element, the first frame element and the second frame element being disposed perpendicular to each other, with at least one cleaning unit, which is disposed on the displacement unit, and comprises at least one high-pressure hose and at least one drive unit, where the high-pressure hose can be shoved into the tubes by the drive unit, and with a control unit, which is connected to the displacement unit and to the drive unit.

BACKGROUND OF THE INVENTION

Tube bundles are found in industrial use in diverse applications, such as heat exchangers, condensers, air coolers, and so on. Depending on the heat transfer agent, one cannot avoid the tubes of the bundle becoming clogged or encrusted with dirt and grime over a lengthy period of use, which may even result in the total failure of individual tubes. It is therefore necessary from time to time to clean the inside of the tubes of such bundles and if need be the surface of the tube bundle.

At present, this is usually done by opening and manually approaching the tube bundle and pushing a high-pressure hose provided at its front end with a spray nozzle through the individual tubes, so that water or the like spraying from the spray nozzle, which may have a pressure of 25 to 3000 bar in the high-pressure hose, removes the deposits on the inner walls of the tubes. In this process, the operator is subjected to various dangers, depending on the setting in which the tube bundle is located and the nature and quality of the dirt in the tubes. Furthermore, with a manual cleaning by an operator it cannot be reliably prevented that individual tubes might be inadvertently left out from the cleaning and not get cleaned.

A method for the cleaning of tube bundles according to the preamble of patent claim 1 and a device for the cleaning of tube bundles according to the preamble of patent claim 16 is already known from DE 34 18 835 C2. This known device is used in particular to clean radioactively contaminated tube bundles in simple fashion and substantially with no manual working in their immediate proximity. For this, a video camera and lamps are arranged on a cleaning cart in the known device and a remotely disposed control device is provided with hand levers and with a monitor for the video camera, which controls the movements of the cleaning cart and the high-pressure hose.

But this semiautomatic solution (as it were) still requires operating personnel who control the remote control device with hand levers and track the activity through the images of the video camera. Thus, operating errors are still not precluded, i.e., it cannot be assured that all tubes of the particular bundle are being cleaned.

SUMMARY OF THE INVENTION

The problem which the invention proposes to solve is to improve a method and a device of the kind mentioned above so that a fast and reliable operator-free cleaning occurs.

This problem is solved by a method for cleaning of tube bundles with open end faces, especially tube bundles of heat exchangers, air coolers or condensers, comprising the steps of: positioning a cleaning device having at least one cleaning unit adjacent to the open ends of the tube bundle and then arranging the cleaning unit comprising at least one high-pressure hose by a control unit successively flush with a particular tube of the tube bundle and inserting the cleaning unit into the particular tube and supplying the cleaning unit with a liquid under high pressure, wherein during the inserting of the at least one cleaning unit into the respective tube a depth of insertion is measured and monitored by the control unit; a device for cleaning of tube bundles with open end faces, especially tube bundles of heat exchangers, air coolers or condensers, comprising: frame elements which can be traveled in horizontal and vertical direction by a control unit, in which is disposed at least one drive unit for a cleaning unit comprising a high-pressure hose and connected to the control unit, wherein the cleaning unit can be shoved by the drive unit into the tubes of the tube bundle, wherein the drive unit and/or the cleaning unit is outfitted with a measuring unit for measuring the respective depth of insertion of the cleaning unit in the respective tube, the measurement unit being connected to the control unit; and a device for cleaning of tube bundles with open end faces, especially tube bundles of heat exchangers, air coolers or condensers, comprising: a displacement unit, which comprises at least a first frame element and at least a second frame element, the first frame element and the second frame element being disposed perpendicular to each other, with at least one cleaning unit, which is disposed on the displacement unit, and comprises at least one high-pressure hose and at least one drive unit, where the high-pressure hose can be shoved into the tubes by the drive unit, and with a control unit, which is connected to the displacement unit and to the drive unit, wherein the cleaning unit comprises a measurement unit for metering and monitoring a respective depth of penetration Z of the high-pressure hose, the measurement unit is connected to the control unit, and the control unit comprises a storage and documentation unit or is connected to a storage and documentation unit, in which at least the respective measured depth of insertion can be stored.

The method of the aforementioned kind is characterized in that during the inserting of the at least one cleaning unit into the respective tube the depth of insertion is measured and monitored by the control unit.

The monitoring of the insertion depth preferably consists in a constant observation, metering and/or checking of the insertion depth in order to document the progress of the cleaning. It is also possible, in addition or exclusively, to record the maximum insertion depth reached. By the term insertion is meant both the introducing of the high-pressure hose into the tube and the pushing of the high-pressure hose through the respective tube.

An automated cleaning process is provided, wherein the depth of insertion of the cleaning unit is metered and monitored during each (attempted) insertion of the at least one cleaning unit into the respective tube. If the control unit determines that the cleaning unit or the high-pressure hose could not be inserted at all or inserted entirely into the respective tube, an error message is generated which may result, e.g., in a further manual cleaning of the respective tube. Operator errors are for the most part eliminated, since the control unit approaches each tube of the tube bundle with the at least one cleaning unit and an incomplete cleaning of a tube is determined by determination of the respective depth of insertion.

Most particularly preferably, the particular depth of insertion is saved in the control unit or in a storage and documentation unit connected to the control unit and documented for the particular cleaning process. The storage and documentation unit can also be integrated in the control unit. The documentation preferably encompasses the matching up of the particular measured depth of insertion with the respective tube, e.g., the tube number or the location of the tube, which is defined for example by corresponding X and Y coordinates. Moreover, the documentation preferably includes information as to whether each tube was approached and whether each tube was partly or fully cleaned. The completeness of the cleaning is documented by the storing of this data.

The cleaning outcome is documented for each tube, so that a three-dimensional fouling profile of the tube bundle can be constructed with the depths of insertion. Such a fouling profile has the benefit that structural weak points can be derived from it, for example for a heat exchanger, so that targeted design changes can be made in the heat exchanger in order to lessen in future the fouling and the degree of fouling of a tube bundle.

In this way, it is possible to completely document the cleaning outcome, i.e., it can be demonstrated to the user whether a complete cleaning of all tubes of the tube bundle has been accomplished or not. In the case of incomplete cleaning, such that the efficiency of the tube bundle is affected, a further cleaning (including manual cleaning) can then be done specifically.

In order to shorten the cleaning time, it is preferably provided that a cleaning device is used with several parallel cleaning units, which are inserted at the same time into neighboring tubes and whose depth of insertion is metered and monitored independently of each other.

In a most especially preferred embodiment, the respective arrangement and insertion movement of the respective cleaning unit is performed automatically or semi-automatically by the control unit with the aid of stored geometrical data of the tubes of the bundle. By geometrical data of the tubes is meant preferably the location coordinates of the tubes. The geometrical data can also encompass tube spacings and/or diameter and/or length of the tubes and/or the number of tubes.

After the positioning of the cleaning device at the end face of the respective tube bundle, the cleaning process can occur fully automatically.

In the case of a semiautomatic performance of the cleaning process, certain tasks are undertaken by an attending worker. This includes, e.g., the manual approaching of reference points, reference tubes, or rows of tubes, such as tube rows or tube columns. During the manual approaching or manual mode of the cleaning device, corresponding control commands are entered by the attending worker into the control unit, preferably by means of a remote control. The remote control can be connected by a cable or by radio to the control unit.

The fully or semi-automatic cleaning of the tubes has the advantage that the attending worker can stand at a distance from the tube bundle, heat exchanger, etc., being cleaned. The attending worker can be situated outside of the danger zone and thus does not come into contact with the tube contaminants during the cleaning process. A visual contact with the end surface of the tube bundle is not required, since the enabling of the approaching of the next position is done via the feedback of the servo motors for the hose drive. For example, the command to move on and save the data can be given then.

There are economic benefits, in addition to the benefits of labor safety.

For example, the manual cleaning of a tube bundle comprising 6000 tubes formerly required two persons working in two shifts for 10 days. By the method according to the invention, this work can be accomplished in a quarter to a third of the time expenditure.

If the geometrical data of the particular tube bundle is not available, according to another preferred embodiment the geometrical data of the tubes of the tube bundle is acquired by manual approaching of the tubes with the at least one cleaning unit. The at least one cleaning unit is then positioned by an attending worker at all tubes of the bundle in succession by manual intervention in the control unit, without inserting the cleaning unit or the high-pressure hose into the tubes.

If it does not merely involve the acquisition of tube data, the high-pressure hose or the high-pressure hoses can also be inserted into the tubes during this first-time run and the cleaning process carried out at once.

The geometrical position of all tubes of the bundle is detected and saved, so that the geometrical data is stored for the later cleaning process or cleaning processes in future. Each subsequent cleaning process can then be done on the basis of the geometrical data so acquired, once again in fully or semi-automatic manner.

Preferably, the measurement of the depth of insertion is done by a servo motor of a drive unit for the high-pressure hose of a cleaning unit. By servo motor is meant electric motors enabling a checking of the angle position of the motor shaft as well as the angular velocity and the acceleration. Servo motors generally comprise a sensor for position determination of the motor shaft. The rotary position of the motor shaft as determined by the sensor is relayed to an electronic controller, which is called a servo controller.

The measurement of the depth of insertion is determined by evaluating, e.g., the number of revolutions of the drive shaft, taking into account the circumference of a drive roller for the high-pressure hose. The depth of insertion can be ascertained with high accuracy in this way.

Preferably the torque of the servo motor is metered—continuously or discontinuously—during the inserting of the high-pressure hose into the tube and the torque data is saved along with the respective depth of insertion in the control unit or in a storage and documentation unit connected to the control unit. From the torque values, one can infer the degree of fouling of the particular tube.

Preferably, upon rise in the torque of the servo motor beyond a predetermined value during the insertion process the servo motor is switched off, for example, switched to a free flushing mode, to the return stroke, or to a shaker mode. If the torque during the insertion rises beyond a predetermined value and does not then drop to the normal value again, the obstacle cannot be removed or not easily removed and the cleaning process should be terminated for the time being at this site, in order not to damage the servo motor and/or the exit nozzle situated at the front end of the high-pressure hose.

The servo motor can alternatively be switched to a free flushing mode, in which the tip of the hose is held for a given time in front of the obstacle, the obstacle is sprayed with the cleaning fluid under high pressure, and after the time has elapsed the high-pressure hose is advanced once more. Thanks to this measure, the obstacle can be flushed away in certain cases, so that the cleaning process can run to its end in this tube as scheduled.

In such cases, the servo motor can also be switched at once to the return stroke, in order to retract the high-pressure hose from the tube.

The possibility also exists of switching the servo motor to a shaker mode, so that the hose is moved forward and back for several times, thereby mechanically working on the obstacle and possibly fragmenting it, so that the advancement can continue.

This data is also preferably kept in the control unit of the storage and documentation unit.

Preferably, the slip of the drive unit is monitored during the inserting of the high-pressure hose. By slip is usually meant the deviation in speeds of mechanical elements making frictional contact with each other. In a slip measurement, the difference in rotary speed between two running rollers is determined, for example.

For example, if the drive unit has a drive roller and a pressure roller, the slip can be determined through the rotary speed difference of these two rollers. The benefit of the slip monitoring is that an obstacle inside the tube can be recognized in good time. Furthermore, the slip measurement can be used for correcting the measured depth of insertion. This improves the precision in the determination of the depth of insertion.

Preferably, according to another embodiment, the measurement of the depth of insertion can be done by a sensing of markings applied on or in the high-pressure hose.

Preferably, the cleaning device is attached to the tube bundle. Since the cleaning device preferably comprises a displacement unit, on which the cleaning unit is disposed, the displacement unit is attached to the tube bundle.

Preferably, the displacement unit is attached solely to the tube bundle, preferably to a flange of the tube bundle.

Such a flange is provided at the end face of a tube bundle, in order to fasten a cover there. After removal of the cover, this flange can be used for the attachment of the displacement unit.

This mounting has the benefit that a subframe or cleaning cart is totally unnecessary, which simplifies the mounting of the cleaning device on the bundle being cleaned. Furthermore, the footprint of the cleaning device is significantly smaller than that of traditional cleaning units.

Preferably, before the first-time shoving of the at least one high-pressure hose into the tubes, the orientation of the cleaning device relative to the tube bundle is ascertained and the ascertained data is stored in the control unit and used for correction of the movement trajectory of the cleaning unit. Thus, no mechanical adjustment of the displacement unit is necessary.

The orientation of the cleaning unit primarily concerns the orientation of the displacement unit relative to the series of tubes, i.e., the tube rows or tube columns, wherein a so-called angle offset may occur. By factoring in the angle offset, the accuracy of the approach and thus the reliability of the cleaning device is further improved.

The invention also calls for a device with the features of patent claim 16 for the solving of the problem stated above. The device is characterized in that the drive unit and/or the cleaning unit is outfitted with a measuring unit for measuring the respective depth of insertion of the cleaning unit in the respective tube, the measurement unit being connected to the control unit.

The device according to another embodiment calls for a displacement unit comprising at least a first frame element and at least a second frame element, the first frame element and the second frame element being disposed perpendicular to each other. Moreover, at least one cleaning unit is provided, which is disposed on the displacement unit, and comprises at least one high-pressure hose and at least one drive unit, where the high-pressure hose can be shoved into the tubes by means of the drive unit.

A cleaning device can comprise at least one cleaning unit. A cleaning unit can comprise at least one drive unit, where each drive unit delivers a high-pressure hose.

By a high-pressure hose is meant a hose which can withstand a pressure of 25 bar to around 3000 bar. At the front end which is shoved into the tubes, the high-pressure hose can be outfitted with an exit nozzle or lance. A lance is a piece of pipe having an exit nozzle disposed at or integrated into its front end.

Furthermore, a control unit is provided which is connected at least to the displacement unit and to the drive unit.

The cleaning unit comprises a measurement unit for metering and monitoring the respective depth of penetration Z of the high-pressure hose, the measurement unit being connected to the control unit. The control unit comprises a storage and documentation unit or is connected to a storage and documentation unit, in which at least the respective measured depth of insertion can be stored.

Preferably, the displacement unit comprises means of attachment to the tube bundle. Preferably these means are designed so that the displacement unit can be attached only to the tube bundle.

This has the benefit that the displacement unit does not require any further frame or the like or a cleaning cart on which the displacement unit is mounted. The displacement unit and thus the entire cleaning device is thus compact and requires only a small footprint. Furthermore, the device can be mounted in a brief time on the tube bundle being cleaned.

Another benefit of this embodiment is that the few components of the displacement unit make it easier to transport the overall device. The tube bundle or heat exchanger being cleaned can have any given position. The advantage of the displacement unit is that it can be easily attached to both horizontal and vertical tube bundles. Thus, the cleaning of the tube bundle is not dependent on the position of the tube bundle.

Since the position coordinates of the tubes during the cleaning process are known, the so-called mirror image, or the arrangement of the tubes recognizable at the end face of the tube bundle, can also be different. It is possible that the tubes of the tube bundle are combined in groups in which the tube spacings, for example, can be different, as is the case with partitioned heat exchangers, for example.

According to one preferred embodiment, the first frame element comprises the means of attachment to the tube bundle and the second frame element is arranged on the first frame element so as to travel along the first frame element.

Thus, the first frame element is attached firmly to the tube bundle and only the second frame element can travel relative to the first frame element. Preferably, the cleaning unit or cleaning units are arranged to travel on the second frame element.

The drive unit comprises at least one driving roller for advancement of the high-pressure hose. In order to lessen the slip of hose and driving roller, preferably at least one pressing roller is provided for pressing the high-pressure hose against the driving roller.

According to another embodiment, the drive unit comprises a slip monitoring unit for the driving roller. This slip monitoring unit is preferably connected to the control unit, so that upon appearance of a slip the drive unit can be switched off to avoid damage to the drive unit or the end of the hose. The data furnished by the slip monitoring unit can also improve the accuracy of the depth of insertion.

Preferably the drive unit comprises at least one servo motor, which drives the driving roller.

The drive unit can comprise a measuring unit for the measuring of the torque of the servo motor. The benefits of the torque measurement are explained in connection with the method according to the invention.

At the front end of the high-pressure hose there is preferably arranged an exit nozzle. The exit nozzle can comprise one or more exit openings. The exit nozzle can also be arranged rotatably and be driven, for example, by the cleaning fluid flowing through the high-pressure hose.

The storage and documentation unit is preferably designed for the storing, processing, preparing and evaluating of data accruing during the operation of the cleaning device and/or data which has been entered.

In order to shorten the cleaning time, it is preferably provided that several parallel cleaning units are provided with their own drive unit, where each cleaning unit and/or each drive unit are outfitted with their own measuring unit.

According to one embodiment, the respective measuring unit comprises measuring sensors and measurement markings on a high-pressure hose interacting with the markings. Thus, a magnetic sensing, an ultrasound sensing or also the measuring of ohmic inductive or capacitive resistances or a visual verification with a suitable camera can be considered. Eddy current sensors can also be used, which can measure spacings on metallic high-pressure hoses with no contact and no wear and with extremely high resolution down to the nanometer range. The high-frequency field lines of the sensors responsible for the measurement principle pass unhindered through nonmetallic media. This quality enables a measurement under oil or water pressure or under heavy soiling. Housing parts and materials made of plastic can also be penetrated and the metallic objects located behind them can be detected. Paints and films can be investigated for layer thickness.

In addition or alternatively, it can also be provided that the particular measurement unit comprises roller sensors resting against the surface of the high-pressure hose. The depth of insertion of the particular high-pressure hose can then be determined from the number of revolutions of the roller sensor.

The respective cleaning unit can comprise a high-pressure hose with exit nozzle.

Alternatively, the respective cleaning unit can also comprise a high-pressure hose with connected lance, which can be shoved into the respective tube.

The frame elements consist preferably of a bending-resistant profile and can be outfitted for example with racks with which the particular driving units can engage for the travel of the cleaning unit.

BRIEF DESCRIPTION OF THE DRAWINGS

The invention is explained more closely below by means of the drawings, as an example. These show, each time in greatly simplified schematic representation.

DETAILED DESCRIPTION OF THE INVENTION

Figure 1:
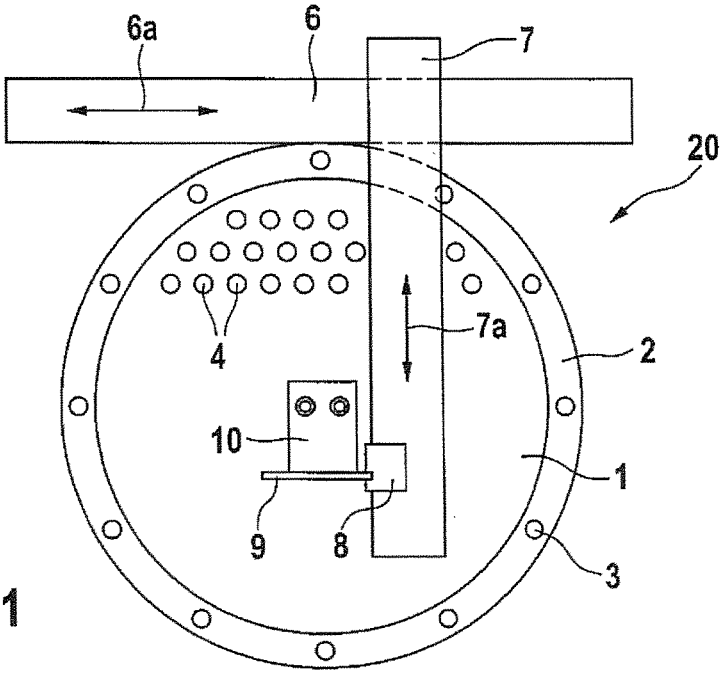
FIG. 1, the end face of an open tube bundle with the device of the invention attached to it, FIG. 2, a side view of FIG. 1, FIG. 3, a portion of a high-pressure hose with spaced-apart measurement markings, FIG. 4, a top view of the end face of an open tube bundle with a tube cleaning device of another embodiment, FIG. 5, another top view of the end face of the tube bundle with a displacement unit according to another embodiment, FIG. 6, a schematic representation of a driving unit of a drive unit, and FIGS. 7 and 8, two different encrustation situations in a tube with corresponding torque diagrams of a servo motor.

In the drawings, a tube bundle 1 is represented, for example that of a tube bundle heat exchanger, where the open end face can be seen, i.e., a closure cover or the like has been removed. The cover is normally attached to a flange or flange region 2 with fastening openings 3. The tube bundle 1 comprises, in the horizontal direction in the sense of FIG. 1, a plurality of parallel tubes 4, of which only a few are indicated.

For the automatic cleaning of the tubes 4 of the tube bundle 1, a cleaning device according to the invention is provided, being generally indicated as 5.

This device 5 comprises at least two frame elements, namely, a horizontal frame element 6 and a vertical frame element 7. These frame elements 6, 7 are thus arranged perpendicular to each other. The horizontal frame element 6 can travel in the direction of the double arrow 6*a* in the horizontal direction with a drive unit, not shown, the vertical frame element 7 can travel in the vertical direction in the sense of the double arrow 7*a* relative to the horizontal frame element 6 with a drive unit likewise not shown. A reversed arrangement is also possible. The two frame elements 6, 7 can be arranged on a cleaning cart (not shown), which can but need not have its own travel drive unit.

The two drive units of the two frame elements 6 and 7 are connected to a control unit 50, not shown, which makes it possible to position a bearing point 8 on the frame element 7 at any given point of the end face of the tube bundle 1. At this bearing point 8 is attached a support frame 9, on which a cleaning unit 20 is arranged. The cleaning unit 20 comprises a high-pressure hose 11 and a drive unit 10 for the high-pressure hose 11.

Figure 2:
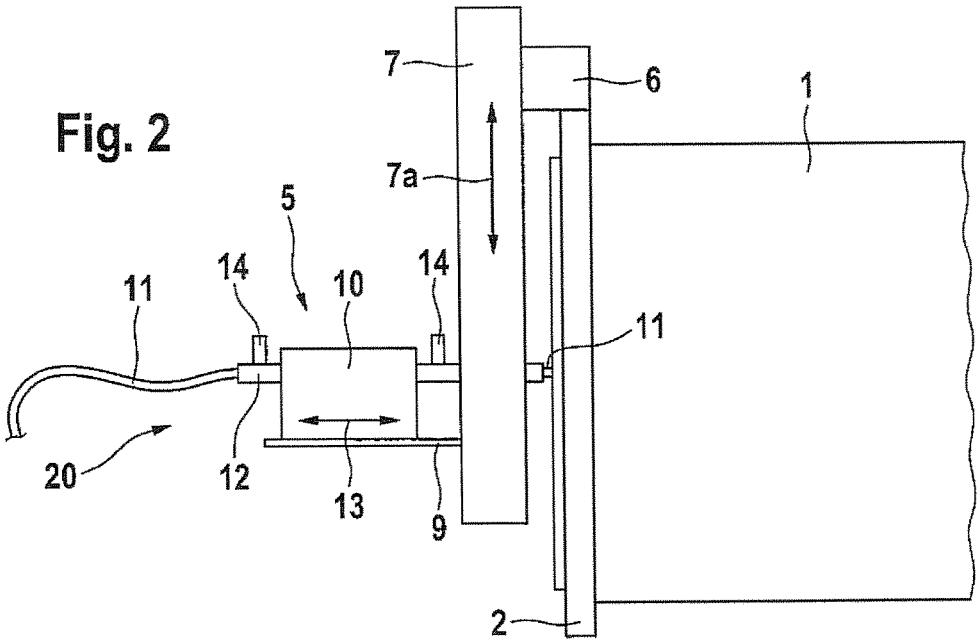

This drive unit 10, as shown in FIG. 2, has a tubular hose guide 12 as well as at least one driving roller 32, not shown, for inserting the hose 11 into a tube 4 of the tube bundle 1 or for pulling it out therefrom, i.e., for moving the hose 11 in the direction of the double arrow 13. The at least one driving roller 32, not shown, is connected to a drive, not shown, which in turn stands in connection with the control unit 50. The cleaning unit 20 of this sample embodiment comprises the high-pressure hose 11 shown, which has at its front free end a nozzle, not shown. At the rear, the high-pressure hose 11 is connected to a high-pressure pump or the like.

A second or further cleaning units 20 can also be provided on the support frame 9 at a spacing, so that when the support frame 9 is positioned accordingly with respect to the tube bundle 1 several high-pressure hoses 11 can be shoved at the same time into neighboring tubes 4.

Figure 3:
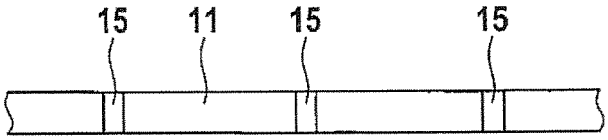

The drive unit 10 and/or the cleaning unit 20, i.e., the high-pressure hose 11 in the sample embodiment, are outfitted with a measurement unit 40 for measuring the respective depth of insertion of the high-pressure hose 11 into the respective tube 4. In the sample embodiment shown, two measuring sensors 14 are provided at the input and output of the drive unit 10. The high-pressure hose 11 according to FIG. 3 is provided with markings 15 at equal spacings, e.g. in the form of magnetic strips, which can be detected by the sensors 14. The sensors 14 are connected to the control unit 50.

In this way, it is possible to measure the respective depth of insertion of the high-pressure hose 11 of the respective cleaning unit 20 in the respective tube 4 and relay the measurement result to the control unit 50.

The measurement of the depth of insertion of the respective high-pressure hose 11 into a tube 4 can basically be done in any given manner, e.g., it is also possible for each high-pressure hose 11 to move via its own servo motor 30 and for the depth of insertion to be measured via the servo motor 30 as the measuring unit 40.

For the cleaning of a tube bundle 1, the device 5 is arranged at the end face of the open tube bundle 1, and then the further cleaning sequence is fully automatic. Preferably, the geometrical data of the tubes 4 of the tube bundle 1 is stored in the control unit 50, so that the control unit 50 automatically positions the respective cleaning unit 20 successively at the tubes 4 of the tube bundle 1.

If the geometrical data of the tubes 4 of the tube bundle 1 is not known, this can be detected or acquired manually with the cleaning device 5. For this, an attendant by manual intervention in the control unit 50 consecutively traces or senses each tube 4 of the tube bundle 1 with the at least one cleaning unit 20, so that the cleaning unit 20, i.e., the tips of the high-pressure hose 11 for example, is situated at the entrance of the respective tube 4. In this way, all tube positions are detected and saved in the control unit 50. The geometrical data detected in this way can then be used for the subsequent cleaning process or later cleaning processes.

The respective cleaning unit 20 or the high-pressure hose 11 is then introduced by the corresponding drive unit 10 into the respective tube 4 and water or the like is supplied under high pressure in order to carry out the cleaning process in the respective tube 4. Thanks to the respective measuring of the insertion depth, which can also be equal to zero when the entrance to a tube 4 is fully closed, the depth of insertion of each tube 4 is measured and monitored by the control unit 50. If no cleaning or only an incomplete cleaning of a tube 4 occurs, the control unit 50 can put out an error message directly, or also a warning message. In addition, the depth of insertion measured for each tube 4 is stored in the control unit 50 and documented for the respective cleaning process.

It is thus documented for the user in distinctive manner after the end of the cleaning whether the cleaning has been done correctly for all tubes 4 or not. In the latter case, additional cleaning measures can then be taken, if need be.

Figure 4:
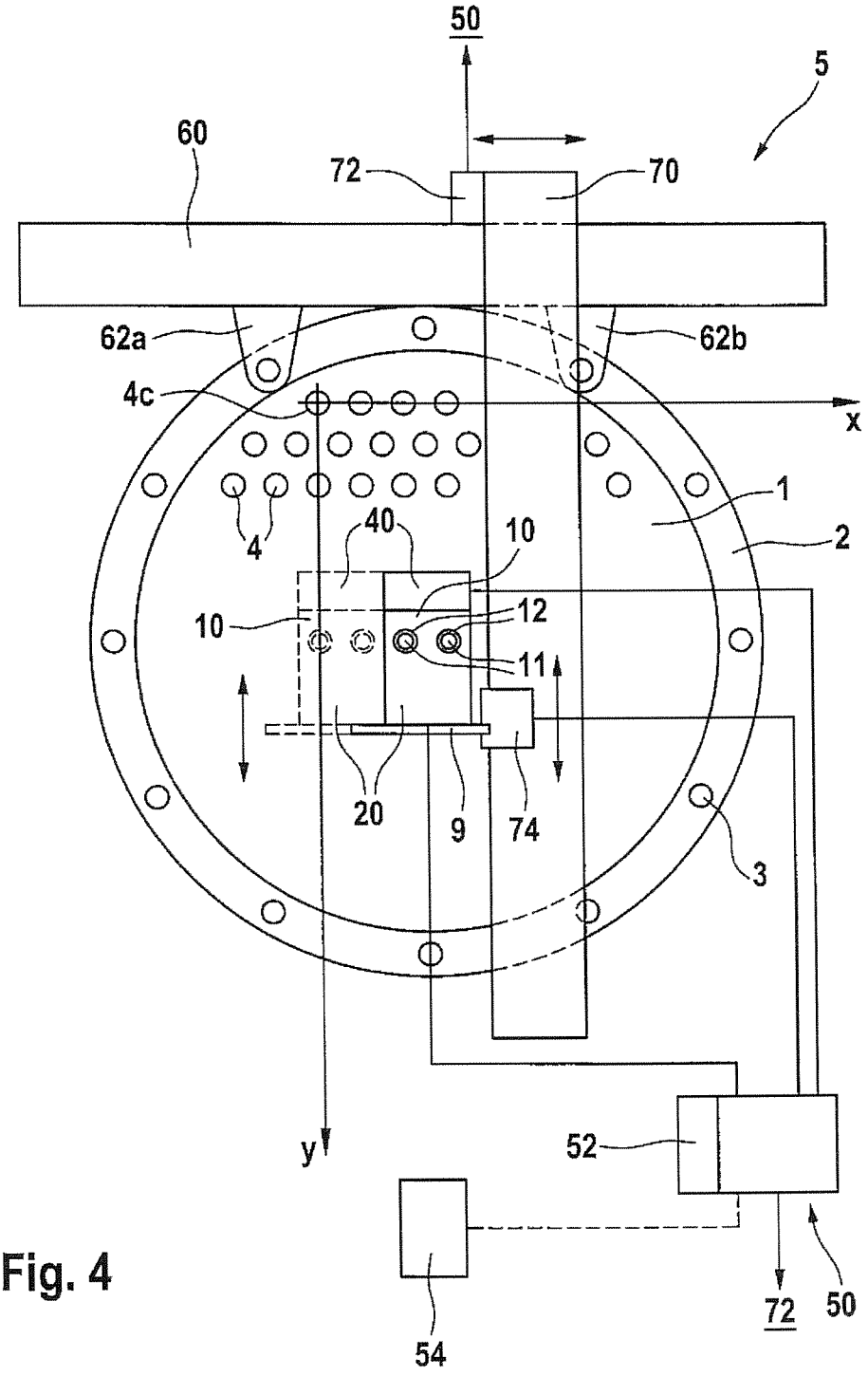

FIG. 4 shows another embodiment of a cleaning device 5, comprising a displacement unit 25 with a first frame element 60 and a second frame element 70. The first frame element 60 comprises fastening means 62*a, b*, which in the embodiment shown here are configured as lugs. These fastening means 62*a, b* are fastened to the flange 2 of the tube bundle 1. For this, the fastening openings 3 in the flange 2 are used.

Arranged perpendicular to the firmly mounted first frame element 60 is the second frame element 70, which can travel by means of a driving unit 72 along the first frame element 60 in the direction of the arrow. On the second frame element 70 is arranged a further driving unit 74, which is connected to a support element 9, on which a cleaning unit 20 is arranged. The cleaning unit 20 comprises a drive unit 10 for two hoses 11 as well as a measurement unit 40.

A second cleaning unit 20 can also be arranged on the support frame 9, which comprises like the first cleaning unit 20 a drive unit 10 for two hoses 11 as well as a measurement unit 40. The second cleaning unit 20 is shown in dotted lines.

By means of the driving unit 74, the support frame 9 can travel in the direction of the arrow along the second frame element 70. The driving units 72 and 74 as well as the drive unit 10 and the measurement unit 40 are connected to a control unit 50, which has a storage and documentation unit 52. Moreover, a remote control 54 is provided, with which an attendant can relay commands to the control unit 50.

Moreover, a coordinate system is indicated, whose zero point lies in the tube 4*c*, which serves as the reference tube in the present case. The tube 4*c* is located at the left end of the upper tube series and constitutes the starting point for the cleaning process. Starting from tube 4*c*, the tubes 4 are driven over in series, until all tubes 4 have been cleaned. Basically, any desired tube 4 can be chosen as the reference tube 4*c*.

This coordinate system as well as the tube coordinates x and y situated in this coordinate system are stored in the control unit 50 or the storage and documentation unit 52. This geometrical data can be ordered from the manufacturer or operator of the tube bundle 1 and entered into the control unit 50. It is also possible to use the remote control 54 to manually travel over the tubes 4 individually and save the corresponding x, y data in the control unit 50 or the storage and documentation unit 52 and preferably also carry out the cleaning of the tubes 4 at the same time.

With the aid of this data, the cleaning process can then be carried out, where only the tube 4*c* is approached manually. The process can then run fully or semi-automatically, while the switch from one tube series to the next can be done manually, for example. The saving of the depth of insertion for each tube can also be done manually with the remote control 54.

Figure 5:
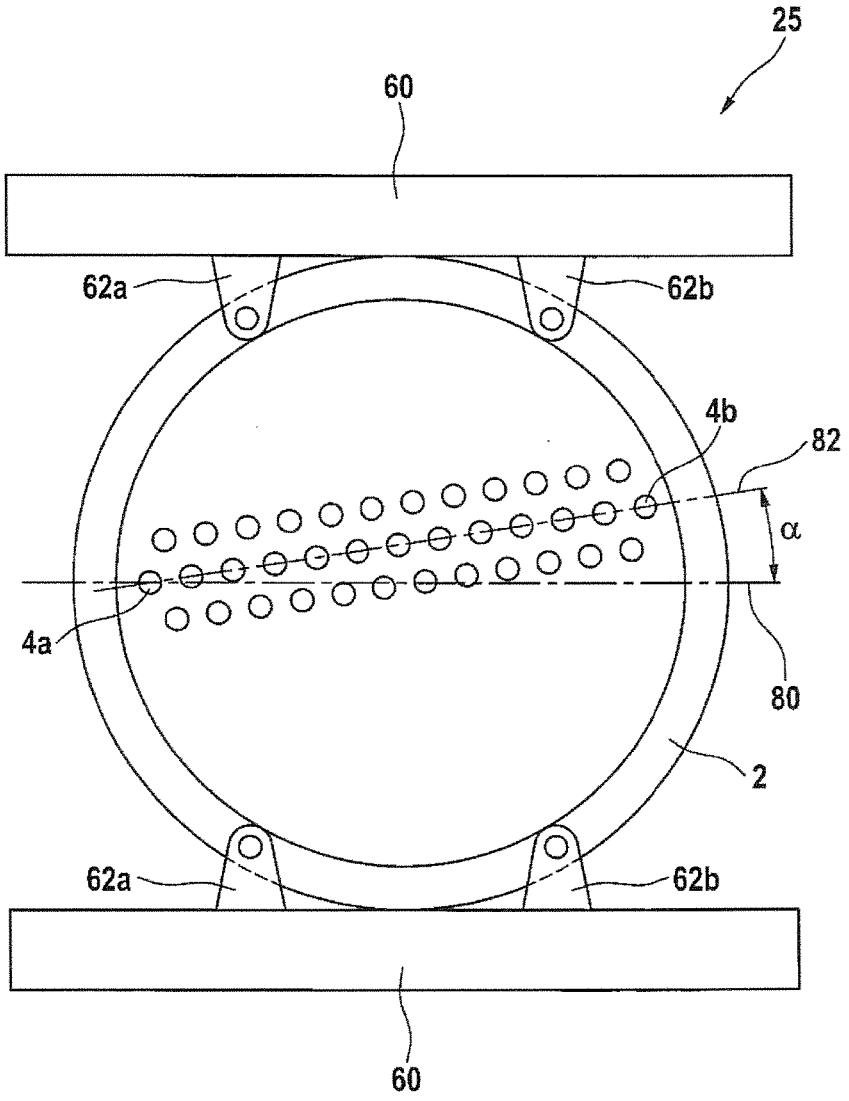

In FIG. 5, the first frame element 60 is attached to the flange 2 in the same way as in FIG. 4. For stability reasons, it can be advantageous to arrange an additional first frame element 60 on the opposite side of the flange 2. The second frame element 70, not shown, can travel on both frame elements 60.

Before the cleaning process is performed, one must check the orientation of the displacement unit 25 with respect to the tube arrangement. As a rule, the first frame element 60 might not be positioned in parallel with the tube series 82 on the flange 2, so that an angle offset a occurs. This angle offset a between the parallels 80 to the first frame element 60 and the tube series 82 is ascertained and saved in the control unit 50, so that this angle offset a can be factored into the local coordinates x, y of the tubes 4 and be taken into account when moving the cleaning unit 20.

For this, the tube 4*a* for example is approached manually with the cleaning unit 20 and the position is memorized. Next, the cleaning unit 20 moves in front of the tube 4*b* and this position is likewise saved, from which the angle α of the tube series 82 to the parallels 80 can then be ascertained.

Figure 6:
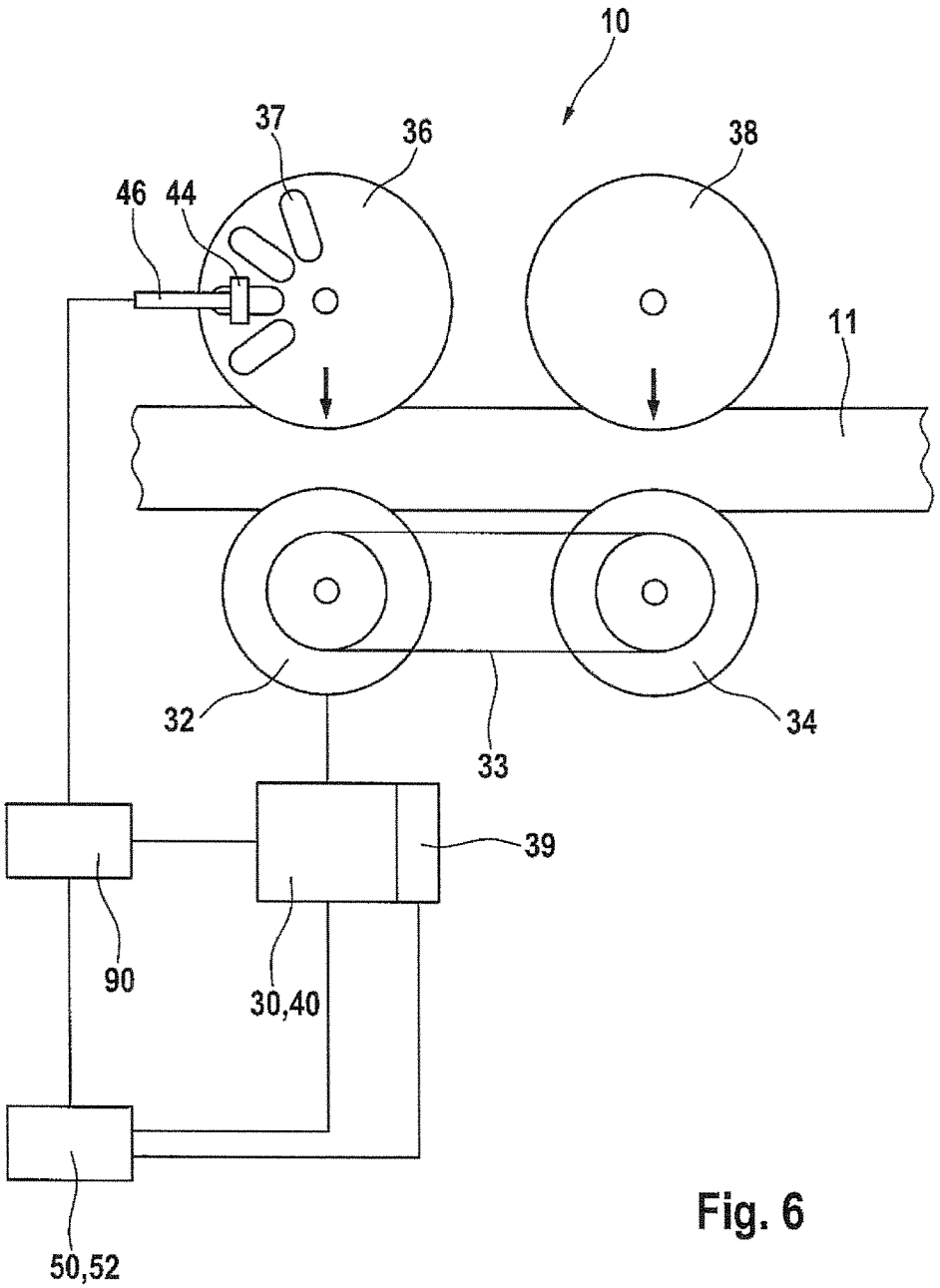

FIG. 6 shows schematically a drive unit 10 for the high-pressure hose 11, comprising two driving rollers 32 and 34, which are interconnected by a belt or chain drive 33. The driving roller 32 is driven by a servo motor 30, which is connected to the control unit 50.

Pressing rollers 36 and 38 are arranged above the high-pressure hose 11 being transported and are used to press the high-pressure hose 11 against the driving rollers 32 and 34, thus largely preventing a slippage of the high-pressure hose 11 on the driving rollers 32, 34. The additional driving roller 34 and pressing roller 38 can be omitted when the high-pressure hose 11 and the driving rollers 32, 34 have appropriately roughened surfaces, so that no slippage on the driving rollers 32, 34 occurs.

In front of the upper pressing roller 36, which is driven by the high-pressure hose 11 and has depressions or openings 37 arranged on a circle, there is arranged a roller sensor 44 by means of a sensor holder 46, which is connected to a slip monitoring unit 90. With the sensor 44, the rotational velocity of the pressing roller 36 is detected. This slip monitoring unit 90 is also connected to the servo motor 30 and the control unit 50.

If the high-pressure hose 11 encounters an obstacle inside the tube 4 being cleaned, the high-pressure hose 11 is braked and there is a danger that the driving roller 32 will nevertheless continue to run. Since the depth of insertion is ascertained through the servo motor 30 and thus the servo motor 30 also forms the measuring unit 40, this would lead to an error in the determination of the depth of insertion. This problem can be recognized by means of the slip monitoring unit 90, so that the servo motor 30 is switched off at once and any further running of the driving roller 32 can be factored into the calculation of the depth of insertion.

One of the pressing rollers 36, 38 can also be designed as a roller sensor when a high-pressure hose 11 with markings 15 is used, as shown in FIG. 3. This pressing roller 36, 38 in such an embodiment is part of the measurement unit 40 for measuring the depth of insertion and is connected to the control unit 50 or the storage and documentation unit 52.

Figure 7:
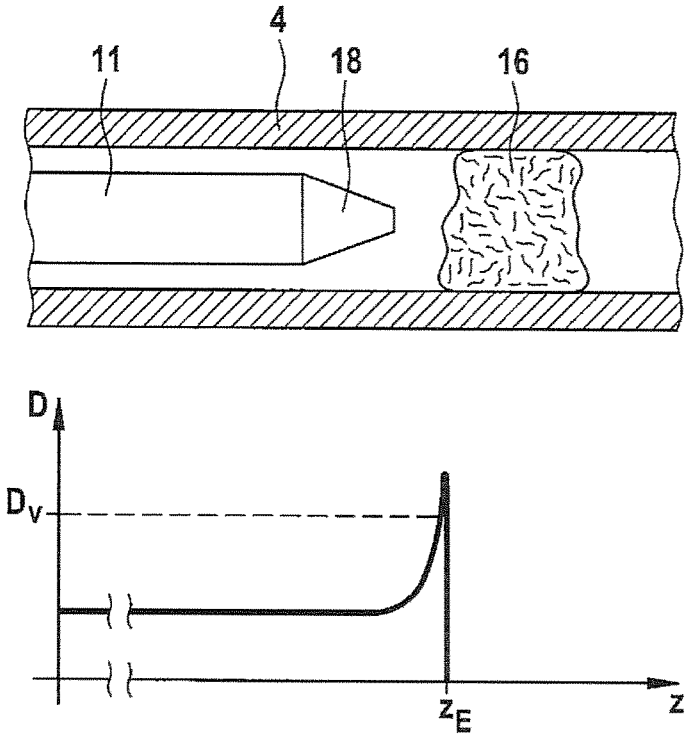
Figure 8:
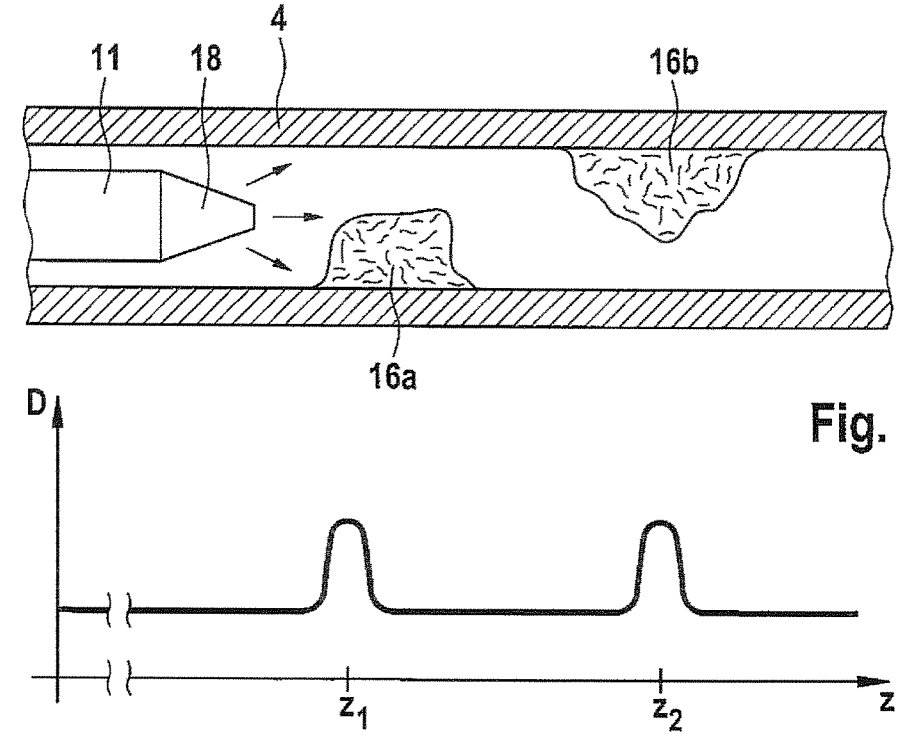

FIGS. 7 and 8 show various obstacles in the form of encrustations 16, 16*a*, 16*b* inside the tubes 4. Beneath the respective tubes 4 is a schematic diagram of the torque D as a function of the distance z traveled.

The torque D of the servo motor 30 is constant upon shoving the high-pressure hose 11 into the tube 4 and it rises abruptly when the exit nozzle 18 disposed at the front end of the hose 11 encounters an obstacle in the form of an encrustation 16. The torque D is detected preferably with a torque measuring unit 30, which is arranged in or on the servo motor 30 (see FIG. 6).

This rapid rise is shown in the diagram, this rise marking the depth of insertion $z_E$.

This obstacle cannot be eliminated with the aid of the high-pressure hose 11 and the exit nozzle 18, so that the cleaning process of the tube 4 is ended at this point. It can be read off from the value of the torque D that an impassable obstacle is located here. The corresponding data such as depth of insertion $z_E$ and torque D are saved in the control unit 50 or the storage and documentation unit 52.

FIG. 8 shows a different situation, in which two smaller encrustations 16*a*, 16*b* are shown. When the high-pressure hose 11 comes up against the encrustation 16*a* with the exit nozzle 18, the torque of the servo motor 30 rises. If it is able to loosen this encrustation 16*a*, the advancement of the high-pressure hose 11 can continue, so that the torque of the servo motor 30 again drops until the high-pressure hose 11 encounters the next obstacle in the form of the encrustation 16*b* with the nozzle 18.

If the encrustation 16*b* here can also be loosened and removed, the torque again drops and the advancement can likewise continue.

Thus, from the plot of the torque curve, shown only schematically, one can read off how heavy the fouling or encrustation 16, 16*a, b* is inside the tube 4. Using the data z1 and z2, it is then also possible to localize the site precisely where this fouling occurs.

Thus, with the aid of all the data, a three-dimensional fouling profile of the tube bundle 1 can be constructed, from which the location of the encrustations 16, 16*a, b* and the degree of the encrustation or fouling can be seen.

A sample cleaning process for a tube bundle 1 can take place as follows:

The individual frame elements 6, 7 or 60, 70 are delivered along with the cleaning unit or units 20 and the control unit 50 and assembled on site to form a cleaning device 5. First of all, the first frame element 6, 60 is mounted on the tube bundle 1 and then the second frame element 7, 70 is mounted on the first frame element 6, 60.

The benefit of the device is, among other things, that the frame elements can be mounted on both horizontally oriented tube bundles 1 and vertically oriented tube bundles 1. The device 5 can be employed much more flexibly than is the case with tube cleaning devices of the prior art, which are mounted for example on a cart which has to travel up to the tube bundle 1 being cleaned, which is only possible in the case of horizontally situated tube bundles 1.

Next, the angle offset a is ascertained and the working range is determined. For this, for corner points of a rectangle lying outside the tube bundle 1 are driven to. The end face of the tube bundle 1 is then situated inside the working zone in which the cleaning unit(s) 20 can travel.

In the event of a first-time cleaning process for a tube bundle 1, it is necessary to enter the geometrical data into the control unit 50. If this geometrical data of the tubes 4 is provided by the operator or manufacturer of the tube bundle 1 and is then entered into the control unit 50, the cleaning process can be started after the data entry, and the cleaning process begins at a reference tube 4*c* which is approached manually. This can be, e.g., the first tube 4 of the first series of a tube bundle 1. The reference tube 4*c* can also be any given tube 4 of the tube bundle 1. If no geometrical data is available, the geometrical data is determined on site by means of a manual driving to the tubes 4 and preferably the tubes 4 will also be cleaned at the same time.

If the cleaning unit 20 comes up against a tube 4 which is closed with a plug, the high-pressure hose 11 cannot move into the tube 4. Corresponding information is then assigned to this tube 4, that the high-pressure hose 11 could not enter it. This data is then saved in the storage and documentation unit 52.

If the high-pressure hose 11 can move into the tube 4 being cleaned, there are two possibilities. Either the hose can be shoved entirely into the tube 4 as far as the opposite end. Then the cleaning can occur as planned and this cleaning outcome will likewise be documented by saving the tube data and the maximum depth of insertion reached.

If the tube 4 can only be partly entered, the cleaning is not done according to plan. The maximum depth of insertion $z_E$ reached and optionally the torques occurring are ascertained, so that further conclusions can be drawn as to the degree of the fouling. This data is also then saved in the storage and documentation unit 52.

If it is possible to remove the fouling by means of the inserted high-pressure hose 11, this also is saved and documented.

Once all tubes 4 of a tube bundle 1 have been driven to, the cleaning process is ended.

The method according to the invention ensures that no tube is inadvertently forgotten, as can happen with a traditional manual cleaning of the tubes.

If several high-pressure hoses 11 are used at the same time, the cleaning time is further shortened. A travel of the cleaning unit 20 will always occur when all high-pressure hoses 11 have left their tubes 4. In particular, if one of the high-pressure hoses 11 has been driven out from the tube on account of an insurmountable obstacle, it must wait for the other high-pressure hoses 11 which can perform a complete cleaning of their tubes.

LIST OF REFERENCE SYMBOLS

1 tube bundle
2 flange region, flange
3 fastening openings
4 tube
4*a, b, c* tube
5 cleaning device
6 horizontal frame element
6*a* double arrow
7 vertical frame element
7*a* double arrow
8 bearing point
9 support frame
10 drive unit
11 high-pressure hose
12 hose guide
13 double arrow
14 sensors
15 markings
16 encrustation
16*a, b* encrustation
18 exit nozzle
20 cleaning unit
25 displacement unit
30 servo motor
32 driving roller
33 transmission element
34 driving roller
36 pressing roller
37 opening
38 pressing roller
39 torque measuring unit
40 measuring unit
44 roller sensor
46 sensor holder
50 control unit
52 storage and documentation unit
54 remote control
60 first frame element
62*a, b* fastening means
70 second frame element
72 driving unit
74 driving unit
80 parallels
82 tube series
90 slip monitoring unit

What is claimed is:

1. A device for cleaning of tube bundles with open end faces, especially tube bundles of heat exchangers, air coolers or condensers, comprising:

a displacement unit, which comprises at least a first frame element and at least a second frame element, the first frame element and the second frame element being disposed perpendicular to each other, with at least one cleaning unit, which is disposed on the displacement unit, and comprises at least one high-pressure hose and at least one drive unit, where the high-pressure hose can be shoved into the tubes by the drive unit, and with a control unit, which is connected to the displacement unit and to the drive unit, wherein the cleaning unit comprises a measurement unit for metering and monitoring a respective depth of penetration Z of the high-pressure hose, the measurement unit is connected to the control unit, and the control unit comprises a storage and documentation unit or is connected to a storage and documentation unit, in which at least the respective measured depth of insertion can be stored.

2. A method for cleaning of tube bundles with open end faces, especially tube bundles of heat exchangers, air coolers or condensers, comprising the steps of: positioning a cleaning device according to claim 1 having the at least one cleaning unit adjacent to the open ends of the tube bundle and then arranging the cleaning unit comprising at least one high-pressure hose by the control unit successively flush with a particular tube of the tube bundle and inserting the cleaning unit into the particular tube and supplying the cleaning unit with a liquid under high pressure, wherein during the inserting of the at least one cleaning unit into the respective tube a depth of insertion is measured and monitored by the control unit.

3. The method according to claim 2, wherein the particular depth of insertion is saved in the control unit or in a storage and documentation unit connected to the control unit and documented for the particular cleaning process.

4. The method according to claim 3, wherein the documentation involves the construction of a three-dimensional fouling profile of the tube bundle.

5. The method according to claim 2, wherein a cleaning device has several parallel cleaning units, which are inserted at the same time into neighboring tubes and whose depth of insertion is metered and monitored independently of each other.

6. The method according to claim 2, wherein the arrangement and insertion movement of the cleaning unit is performed automatically or semi-automatically by the control unit with the aid of stored geometrical data of the tubes of the bundle.

7. The method according to claim 6, wherein the geometrical data of the tubes of the tube bundle is acquired by manual approaching of the tubes with the at least one cleaning unit.

8. The method according to claim 2, wherein the measurement of the depth of insertion is done by a servo motor of a drive unit for the high-pressure hose of a cleaning unit.

9. The method according to claim 8, wherein the torque D of the servo motor is metered continuously during the inserting of the high-pressure hose into the tube and the measured torque data is saved along with the respective depth of insertion in the control unit or in a storage and documentation unit connected to the control unit.

10. The method according to claim 9, wherein, upon rise in the torque of the servo motor beyond a predetermined value $D_V$, the servo motor is switched off, switched to a free flushing mode, to the return stroke, or to a shaker mode.

11. The method according to claim 8, wherein a slip of the drive unit is monitored during the inserting of the high-pressure hose.

12. The method according to claim 2, wherein the measurement of the depth of insertion can be done by a sensing of markings applied on or in the high-pressure hose.

13. The method according to claim 2, wherein a displacement unit of the cleaning device is attached to the tube bundle.

14. The method according to claim 13, wherein the displacement unit of the cleaning device is attached to a flange of the tube bundle.

15. The method according to claim 2, wherein, before the first-time insertion of the at least one high-pressure hose into the tubes, an orientation of the cleaning device relative to the tube bundle is ascertained and the ascertained data is stored in the control unit and used for correction of a movement trajectory of the cleaning unit.

16. The method according to claim 2, wherein the first tube of the tube bundle being cleaned is approached manually.

17. The device according to claim 1, wherein the displacement unit comprises means of attachment to the tube bundle.

18. The device according to claim 1, wherein the first frame element comprises the means of attachment to the tube bundle and the second frame element is arranged on the first frame element so as to travel along the first frame element.

19. The device according to claim 1, wherein the cleaning unit is arranged to travel on the second frame element.

20. The device according to claim 1, wherein the drive unit comprises at least one driving roller for advancement of the high-pressure hose.

21. The device according to claim 20, wherein the drive unit comprises at least one pressing roller for pressing the high-pressure hose against the driving roller.

22. The device according to claim 20, wherein the drive unit comprises a slip monitoring unit for the driving roller.

23. The device according to claim 20, wherein the drive unit comprises at least one servo motor, which drives the driving roller.

24. The device according to claim 23, wherein the drive unit comprises a torque measuring unit for the measuring of a torque of the servo motor.

25. The device according to claim 1, wherein at the front end of the high-pressure hose there is arranged an exit nozzle.

26. The device according to claim 1, wherein the storage and documentation unit is designed for the storing, processing, preparing and evaluating of data accruing during the operation of the cleaning device and/or data which has been entered.

27. The device according to claim 1, wherein several parallel cleaning units are provided with their own drive unit, where each cleaning unit and/or each drive unit are outfitted with their own measuring unit.

28. The device according to claim 27, wherein the respective measuring unit comprises measuring sensors and measurement markings on a high-pressure hose interacting with the markings.

29. The device according to claim 28, wherein the particular measurement unit comprises roller sensors resting against the surface of the high-pressure hose.

30. The device according to claim 29, wherein the respective cleaning unit comprises a high-pressure hose with connected lance, which can be shoved into the respective tube.

31. A device for cleaning of tube bundles with open end faces, especially tube bundles of heat exchangers, air coolers or condensers, comprising: frame elements which can be traveled in horizontal and vertical direction by a control unit, in which is disposed at least one drive unit for a cleaning unit comprising a high-pressure hose and connected to the control unit, wherein the cleaning unit can be shoved by the drive unit into the tubes of the tube bundle, wherein the drive unit and/or the cleaning unit is outfitted with a measuring unit for measuring the respective depth of insertion of the cleaning unit in the respective tube, the measurement unit being connected to the control unit.

32. The device according to claim 31, wherein the respective cleaning unit is formed by a high-pressure hose with exit nozzle.

* * * * *